United States Patent [19]

Bastenhof

[11] Patent Number: 4,558,474

[45] Date of Patent: Dec. 17, 1985

[54] WAVE GENERATOR

[75] Inventor: Dirk Bastenhof, Langerak, Netherlands

[73] Assignee: Ecopool Design Limited, Channel Islands

[21] Appl. No.: 520,078

[22] Filed: Aug. 3, 1983

Related U.S. Application Data

[63] Continuation-in-part of Ser. No. 469,521, Feb. 24, 1983, Pat. No. 4,467,483.

[51] Int. Cl.[4] ..... E04H 3/18; E02B 3/00

[52] U.S. Cl. ..... 4/491; 405/79

[58] Field of Search ..... 405/79–81, 405/87, 52; 4/491, 505, 508, 494; 137/596.18, 596

[56] References Cited

U.S. PATENT DOCUMENTS

| | | | |
|---|---|---|---|
| 715,758 | 12/1902 | Cooper | 137/596.18 X |
| 2,056,855 | 10/1936 | Herz | 4/491 |
| 3,005,207 | 10/1961 | Matrai | 4/491 |
| 3,350,724 | 11/1967 | Leigh | 4/491 |
| 3,629,877 | 12/1971 | Schuster | 4/491 |
| 3,789,612 | 2/1974 | Richard et al. | 405/79 |
| 3,977,027 | 8/1976 | Speck | 4/491 |
| 4,276,661 | 7/1981 | Baker | 405/79 X |

FOREIGN PATENT DOCUMENTS

| | | | |
|---|---|---|---|
| 209878 | 6/1907 | Fed. Rep. of Germany . | |
| 1684954 | 11/1971 | Fed. Rep. of Germany . | |
| 709686 | 5/1931 | France . | |
| 942140 | 9/1948 | France . | |
| 101978 | 7/1962 | Netherlands . | |
| 161548 | 9/1979 | Netherlands | 405/79 |
| 163218 | 8/1933 | Switzerland . | |

*Primary Examiner*—Dennis L. Taylor

*Attorney, Agent, or Firm*—Weingarten, Schurgin, Gagnebin & Hayes

[57] ABSTRACT

A pneumatic wave generator for a surf pool, comprising a caisson divided into a plurality of wave generating chambers, a ventilator space provided with a powered source of air and a system of conduits coupled to inlet and outlet valves which together are capable of alternately effecting forced aspiration and expiration above the water surfaces in the wave generating chambers thereby to generate waves in a body of water in communication with the chambers. According to the invention, in each of the wave generating chambers, the coupling of the air inlet valve and the air outlet valve, provided with a common drive, is of great advantage in improving the system efficiency. The expiration may be enhanced by coupling the expirating chambers to the air input of the powered air source forming a closed air pressure system in which a partial vacuum is thus applied to the expirating chambers.

19 Claims, 8 Drawing Figures

WAVE GENERATOR

CROSS REFERENCE TO RELATED APPLICATION

This application is a continuation-in-part of my previous filed copending application entitled Pneumatic Wave Generator, Ser. No. 469,521, filed Feb. 24, 1983, now U.S. Pat. No. 4,467,483.

FIELD OF THE INVENTION

This invention relates to a pneumatic wave generator for a swimming pool with artificial wave generation, referred to herein as a surf pool.

BACKGROUND OF THE INVENTION

Known surf pools comprise a caisson divided into a plurality of wave generating chambers, and a ventilator space with a source of compressed air capable of alternately effecting aspiration and expiration above the water surfaces in the wave generating chambers via a conduit system provided with air inlet and air outlet valves. One such wave generator is shown in U.S. Pat. No. 3,629,877. The particular feature of this prior wave generator is that the maximum wave heights are located in the middle of the swimming pool. Apart from the number of wave generating chambers of a given width, this is achieved by virtue of a swivel channel forcing air alternately into two adjacent wave generating chambers. For this purpose these swivel channels are reciprocated by a pneumatically controlled linkage. As this reciprocation must be effected at a high rate, and a relatively high mass is involved, a relatively high amount of power is required. Moreover, it is not a simple matter to blow air into two adjacent wave generating chambers simultaneously, should this be desired to generate a particular wave pattern.

In this specification the term "aspiration" means the process in which the space above the water in the wave generating chambers is charged with compressed air from a blower, and the term "expiration" means the process in which excess air is let off from the wave generating chambers under the influence of the pressure of the water in the pool.

It is an object of the present invention to make the prior wave generator of simpler and hence of less expensive design, and yet provide more possibilities for varying the wave pattern.

SUMMARY OF THE INVENTION

According to the present invention, the above object is achieved, in principle, by virtue of the fact that, each wave generating chamber has an air inlet valve connected to an air pressure source and an air outlet valve connected for chamber venting on a common drive coupling the valves together.

This principle can be implemented in several ways.

A first embodiment is characterized in that the air inlet valve and the air outlet valve of a wave generating chamber both have a circular aperture in which a butterfly-valve member is provided, the two butterfly-valve members being mounted on a common drive shaft connected to suitable drive means. The rotation of just the butterfly-valve members requires considerably less power than swivelling a swivel channel, as is effected in the prior apparatus.

A second embodiment is characterized in that, in each wave generating chamber, the air inlet valve has an aperture of suitable shape, and the air outlet valve comprises two halves located on opposite sides of the air inlet valve, with, preferably, the valve cover of the air inlet valve being connected by a tensional connecting element to a suitable drive and the valve cover halves of the air outlet valve being connected by tensional connecting elements to the valve cover of the air inlet valve. The tensional connecting elements may comprise cables. The drive may suitably consist of servo cylinders.

The most preferred embodiment of the apparatus according to the invention is characterized in that the conduit system for the aspiration and expiration of the wave generating chamber is integrated with said chambers in a wall of the surf pool, and together with the chambers is built from the material used for the other walls of the pool.

This preferred embodiment may be further characterized in that the front wall of the wave generating chambers, which front wall extends from a side wall of the pool to an opposite side wall, extends from the roof of the wave generating chamber and the conduit system located behind it to a point spaced some distance from the bottom of the pool. In this arrangement, the water passes between its front wall and the bottom, and the rear wall of the wave generating chambers is spaced some distance from the rear wall of the pool to create an interspace therebetween. The interspace is divided by a plate extending substantially horizontally into two parts, where the upper part of which serves as an expiration duct, and the lower part of which serves as an aspiration duct, a source of compressed air being provided beside the ducts outside the pool sidewall concerned, the source being connected at least to the aspiration duct. The valves for this construction most preferably comprise the valves from the second embodiment noted above and integrated into the front wall.

The wave generation according to the present invention is further enhanced by expirating the wave generating chambers into a partial vacuum environment. The partial vacuum is provided by enclosing the air pressure source in at least a partially sealed room and connecting the suction or air supply side of the pressure source to draw air from the expiration ducts.

In a highly suitable form of this embodiment, the cross-sectional area of the expiration duct is greater than the cross-sectional area of the aspiration duct.

In apparatus designed in this way, there may be associated with each wave generating chamber, channels in the wall between said chamber and the aspiration duct and the expiration duct, respectively, which channels are arranged to be shut off by the air inlet valve and the air outlet valve, respectively.

BRIEF DESCRIPTION OF THE DRAWING

Some embodiments of the invention will now be described, by way of example, with reference to the accompanying drawings. In said drawings.

DETAILED DESCRIPTION OF THE DRAWING

Figure 1:
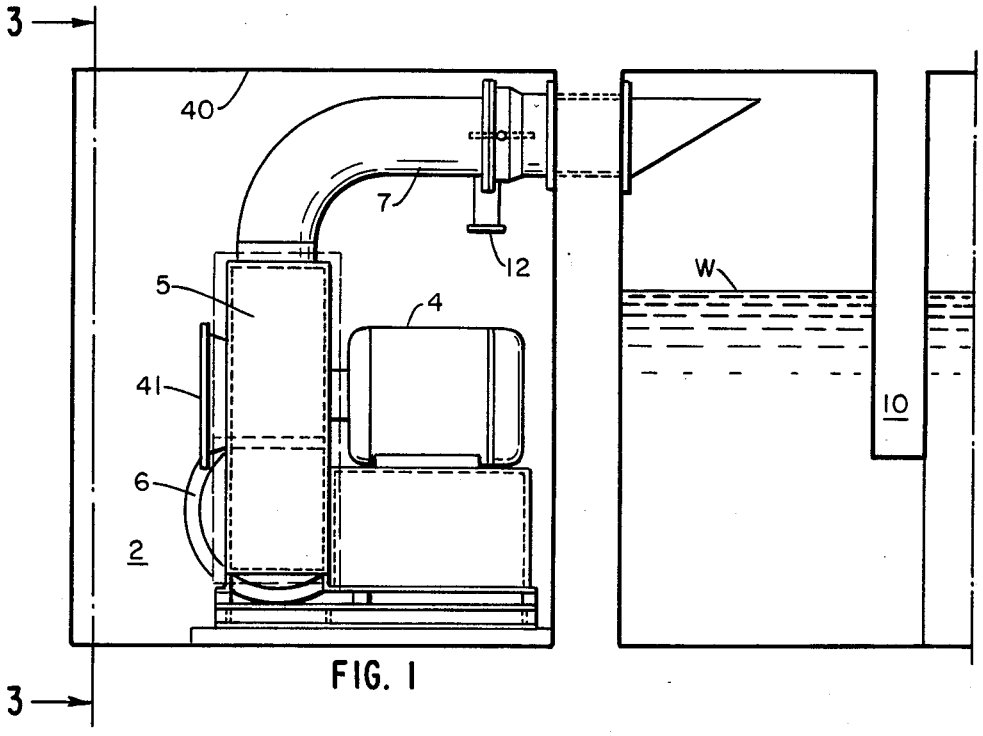
FIG. 1 shows a side elevation view of a ventilator space along with enclosed equipment and adjoining caisson of a surf pool.
Figure 2:
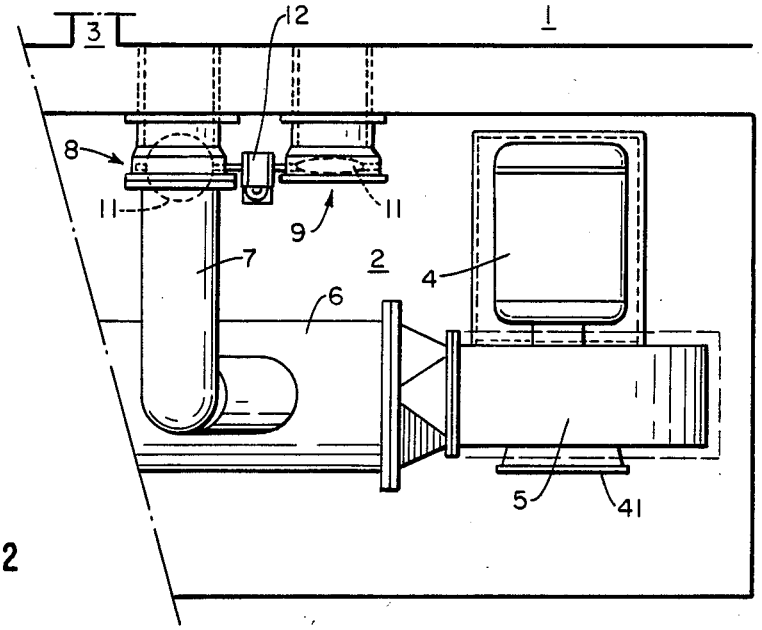
FIG. 2 is a top view of the showing of FIG. 1.
Figure 3:
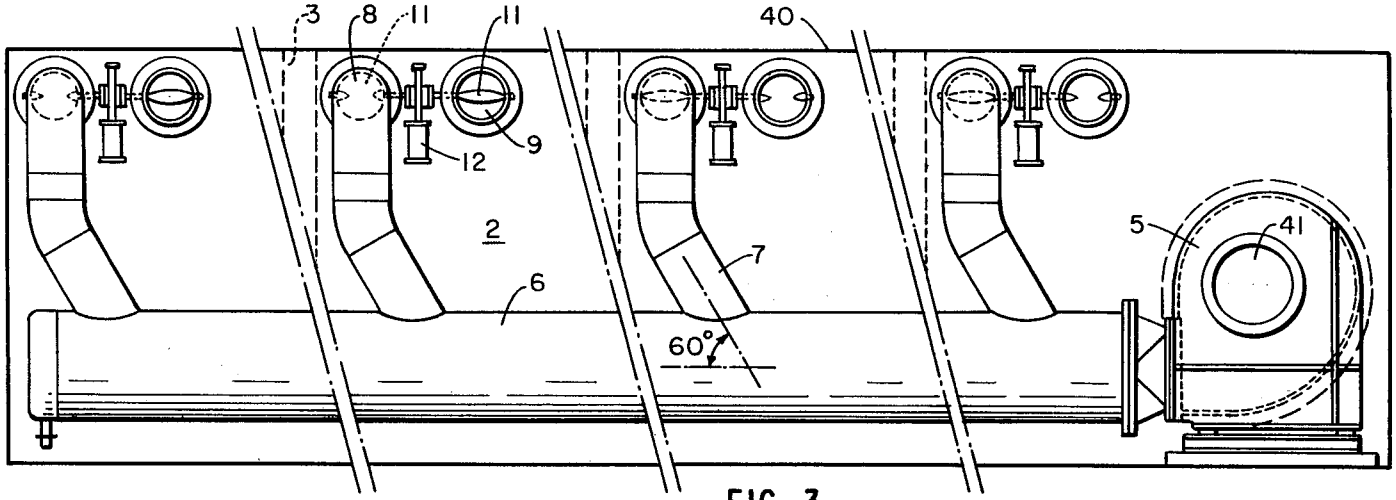
FIG. 3 is an end elevation view according to the arrow III—III of FIG. 1.

The wave generator shown in FIGS. 1–3 comprises a caisson 1 and a ventilator space 2.

Caisson 1 is divided by a plurality of partitions 3 (FIG. 2) into wave generating chambers. Ventilator space 2 comprises a blower 5 driven by a motor 4 capable of supplying compressed air to a duct 6 having branches 7, the number of which is equal to the number of wave generating chambers, or a multiple thereof in the case of large wave generating chambers, where more than one branch may terminate in one chamber.

The compressed air can pass via an air inlet valve 8, if it is in the "open" position, into the wave generating chamber, for this valve is located in front of a duct 7 through the caisson wall, and this at such a level above the water level W that during the expiration via an air outlet valve 9 located just beside the air inlet valve, the water cannot overflow through the valve 9 into the ventilator space. When the blower ventilator during the aspiration phase, forces the water level W in FIG. 1 downwards, this level must not be allowed to be lowered to such an extend that the air can escape under the caisson front wall 10.

In the embodiment of FIGS. 1–3, valves 8 and 9 are provided with butterfly-valve members 11 mounted at right angles to each other on a shaft. When they are rotated by the common drive 12, it is possible to switch rapidly from aspiration to expiration or the other way round.

When the chambers are alternately supplied with air, the water levels in the wave generating chambers are decreased and increased in phase with the load exercised by the air, the water quantities are varied accordingly, and outside the front wall 10 of the caisson the water surface in the immediately adjacent area of the swimming pool assumes a wave configuration as viewed in the transverse direction.

Figure 5:
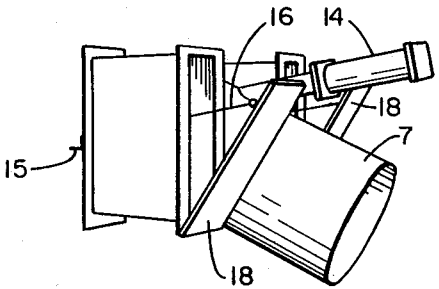
FIG. 5 is a perspective view of the air inlet and air outlet valve of FIG. 4 showing the portion extending into the ventilator space, and in the position for expiration of the chamber.
Figure 4:
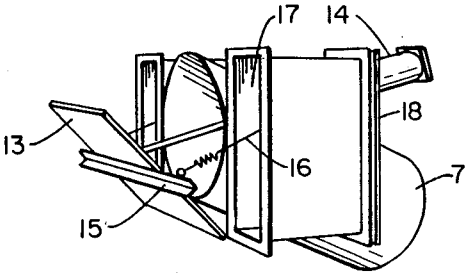
FIG. 4 is a perspective view of an air inlet and air outlet valve, showing the portion protruding into the wave generating chamber, and in the position for aspiration of the chamber.

FIGS. 4 and 5 show a preferred embodiment of the valves. The air inlet valve consists of a rectangular valve cover 13 opening into the chamber 20, which valve cover 13 can be pulled shut by a pneumatic cylinder 14 against the air pressure in the conduit system 6, 7. Provided on valve cover 13 is an extension bar 15 for fastening cables 16 extending through the two air outlet valve halves 17, located on opposite sides of branch 7, to the free ends of the associated valve cover halves 18. Both valve cover 13 and valve cover halves 18 are mounted for pivoting movement about their lower edges. When air is being blown into the wave generating chamber (aspiration—FIG. 4), cable 16 pulls the valve cover halves 18 shut. When valve cover 13 is closed by being pulled shut by pneumatic cylinder 14 (FIG. 5), air is blown out of the wave generating chamber (expiration), by virtue of the valve cover halves being automatically opened by the air pressure in the wave generating chamber.

In an alternate embodiment, the valve halves 17 are vented into a partial vacuum, facilitating the expiration cycle. This partial vacuum is formed at least partially by sealing the ventilator space 2 and drawing the intake air for the blower 5 from this exhaust for the ventilator space. In this manner, the air is more efficiently exhausted from each respective wave generating chamber.

Figure 6:
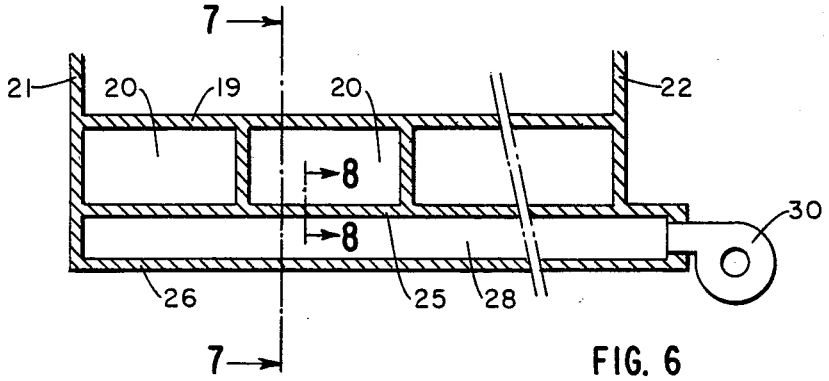
FIG. 6 is a cross-sectional view of the most preferred embodiment of the apparatus according to the invention.
Figure 7:
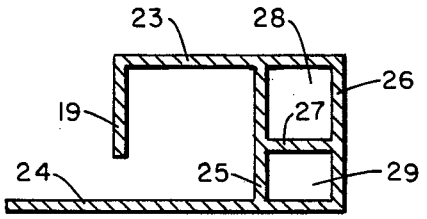
FIG. 7 is a vertical sectional view, taken on the line VII—VII of FIG. 6.

FIG. 6 shows a horizontal cross-sectional view of the most preferred embodiment of the apparatus according to the invention. In this embodiment, the wave generating chambers and the conduit system for aspiration and expiration are fully integrated in a wall of the surf pool, and built from the same material as used for the walls of the pool, for example, concrete. FIG. 7 shows a vertical section through the relevant part of the surf pool, taken on the line VII—VII of FIG. 6.

In this preferred embodiment, the front wall 19 of the wave generating chambers 20, which front wall 19 extends from the side wall 21 of the pool to the side wall 22, extends from the roof 23 of the wave generating chambers 21 and the conduit system located behind it to a point spaced some distance from the bottom 24 of the pool, so that water can pass between front wall 19 and bottom 24. Rear wall 25 of the wave generating chambers 20 is spaced some distance from the rear wall 26 of the pool, to create an interspace therebetween, which interspace is divided by a horizontal plate 27 into two halves. The upper part 28 serves as an expiration duct, and the lower part 29 serves as an aspiration duct. Beside ducts 28 and 29, there is disposed a compressor 30, connected in a suitable manner to these ducts, and in any case, to the aspiration duct 29 for propelling air through it to the wave generating chambers 20. The cross-sectional area of the expiration duct 28, and hence the volume thereof, is greater than that of the aspiration duct 29. It is thus prevented that there is constantly a higher pressure in the wave generating chambers 20 than in the free space outside these chambers. A larger cross-sectional area of duct 28 is desirable for the purpose because the pressure to be exercised for the aspiration by means of the compressor will commonly be higher than the pressure to be exercised for the expiration by the swimming pool water.

The blower 30 can have its air intake connected or positioned to apply a suction to the expiration ducts 28. A partial vacuum is thus applied to the expiration chamber.

The alternating aspiration and expiration of the wave generating chambers 20 is effected by alternately opening and closing valves coupled together with each chamber. The construction of these valves and the operation thereof will be described hereinafter. The aspiration and the expiration of the various chambers 20 is effected in such a sequence as to generate a desired wave form in the surf pool. The sequence of aspiration and expiration and the rhythm in which this is effected can be controlled by operating the systems of valves per chamber in that sequence and in that rhythm. This can be effected, for example, electronically by means of computer control. Any person skilled in the art knows how this can be realized. This manner of operation does not, by itself, form part of the present invention, and therefore needs no further description.

Figure 8:
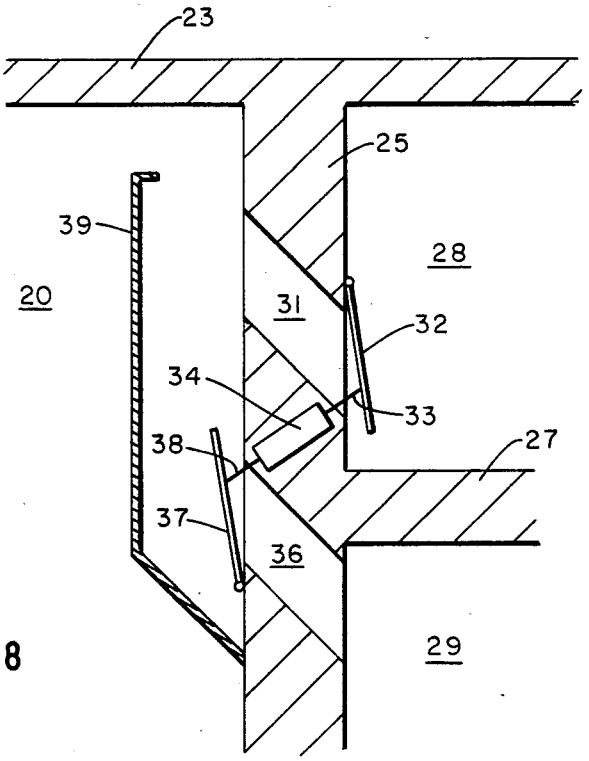
FIG. 8 shows a similar cross-sectional view, taken on the line VIII—VIII of FIG. 6.

FIG. 8 shows a cross-sectional view, taken on the line VIII—VIII of the apparatus illustrated in FIG. 6 at the point where the air inlet valve and the air outlet valve for the relevant wave generating chamber 20 are disposed. In the wall 25 which forms the rear wall of chamber 20, there is provided a duct 31 between chamber 20 and expiration conduit 28. Duct 31 can be shut off by valve cover 32, which via cable 33 is connected to servo cylinder 34. Similarly, in wall 25, there is provided a duct 36 between chamber 30 and aspiration conduit 29, which duct 36 can be shut off with valve cover 37, which by means of cable 38 is connected to servo cylinder 34. Cylinder 34 operates valves 32 and 37 in such a manner that when one valve is open, the other is closed. In front of ducts 31 and 36, an open-topped splash hood 39 may be arranged, which will prevent water from entering conduits 28 and 29 through these ducts.

Instead of a direct duct 36 in wall 25 between aspiration conduit 29 and chamber 20, aspiration may be made through a duct passed through wall 27 between conduits 28 and 29, and terminating via an aperture in the top of wall 25 in chamber 20. In that embodiment the air inlet valve may be arranged in front of the aperture last mentioned and coupled to the air outlet aperture.

In the most preferred embodiment of the invention, the valves of FIGS. 4 and 5 are used in the conduit construction of FIGS. 7 and 8. The valve assembly of FIGS. 4 and 5 is placed in wall 25 between duct 28 and chamber 20. Aspirating air is supplied from duct 29 via an extension of duct 7 on the valve passing through duct 28 and plate 27. Expirating air flows past covers 18 through outlet valve halves 17 into duct 28.

Due to the coupling of the inlet and outlet valves of the system of the present invention, the power necessary to operate the valves is greatly reduced. This results from the fact that the pressures or partial vacuums built up during the pressurizing or venting cycles are at least partially effective to reverse the valve positions for the opposite cycle.

The description above is entended as exemplary of the invention which is defined according to the following claims.

What is claimed is:

1. A pneumatic wave generator for a surf pool, comprising a caisson divided into a plurality of wave generating chambers, and a source of forced air capable of effecting aspiration by applying compressed air to the space above the water surfaces in the wave generating chambers via a conduit system provided with an air inlet valve for said aspiration and an air outlet valve for expiration from said chambers, means for coupling each air inlet valve and air outlet valve to operate together through a common drive means, further including means for connecting said source of forced air to apply suction to a chamber during expiration.

2. The wave generator of claim 1 further including an enclosed space, containing said source of forced air wherein means are provided connecting an intake of said source and said air outlet valve via said enclosed space.

3. The wave generator of claim 2, wherein said enclosed space comprises an equipment room.

4. A wave generating system for use in generating waves in a swimming pool comprising:

one or more chambers communicative with said swimming pool through a below the water passage and having a sealed portion extending above the water level of said pool;

a source of forced air having an air intake;

a source of suction having an air exhaust; and coupled valve means for alternately connecting the forced air and suction to the air intake and the air exhaust into the chambers to create a wave effect in said pool.

5. A wave generating system for use in generating waves in a swimming pool comprising:

one or more chambers communicative with said swimming pool through a below the water passage and having a sealed portion extending above the water level of said pool;

controlled valve means for selectively connecting forced air into each of the chambers to create a wave effect in said pool;

a source of forced air; and a common plenum connecting to each said controlled valve means and said source of forced air.

6. The wave generator according to claim 5, wherein the controlled valve means includes a servo cylinder drive.

7. The wave generator of claim 5, further including an enclosed space, containing said source of forced air wherein means are provided connecting an intake of said source and said controlled valve means via said enclosed space.

8. The wave generator of claim 7, wherein said enclosed space comprises an equipment room.

9. The wave generator of claim 5, further including means for connecting said source of forced air to apply suction to a chamber during expiration.

10. The wave generator according to claim 5, wherein the controlled valve means of at least one of said wave generating chambers has a circular aperture having a butterfly-valve therein.

11. The wave generator according to claim 5, wherein the air outlet of the plenum has a cross-sectional area which is greater than the air inlet of the plenum cross-sectional area.

12. The wave generator according to claim 5, wherein the controlled valve means comprises an air inlet valve and an air outlet valve.

13. The wave generator according to claim 12, wherein each wave generating chamber air inlet valve has an aperture of one shape, and the air outlet valve comprises two sections located on opposite sides of the air inlet valve.

14. The wave generator according to claim 12, wherein the air inlet valve includes an inlet valve cover connected by a tensional connecting element to a drive means, and the air outlet valve sections are connected by tensional connecting elements to the valve cover of the air inlet valve.

15. The wave generator according to claim 14, wherein the tensional connecting elements are cables.

16. The wave generator according to claim 14, wherein each wave generating chamber includes a front wall, rear wall, roof, and two opposite side walls, which front wall extends from one side wall to the opposite said side wall, and extends from the roof of the wave generating chamber and the plenum located behind it to a point spaced-apart from the bottom of the pool, so that water can pass between said front wall and said bottom, and wherein the rear wall of the wave generating chamber is spaced-apart from a rearmost wall of the surf pool to create an interspace therebetween, which interspace is divided into two parts by a plate extending substantially horizontally, the upper part forming an expiration duct, and a lower part forming an aspiration duct of the plenum, and wherein the source of forced air is connected at least to said aspiration duct.

17. The wave generator according to claim 16, wherein the cross-sectional area of the expiration duct is greater than the cross-sectional area of the aspiration duct.

18. The wave generator according to claim 16, wherein each wave generating chamber includes channels in the wall between each said chamber and the aspiration duct and the expiration duct, respectively, and the channels having the air inlet valve and the air outlet valve therein, respectively.

19. The wave generator according to claim 16, wherein the plenum for at least one of the aspiration and expiration of the wave generating chambers is integral with said chambers in a wall of the surf pool, and together with said chambers is built from the material used for the wall of said pool.

* * * * *